US008464375B1

(12) United States Patent
Jorgensen et al.

(10) Patent No.: US 8,464,375 B1
(45) Date of Patent: Jun. 18, 2013

(54) SURGERY CHEST PAD PROTECTION DEVICE

(75) Inventors: Vince Jorgensen, Union City, CA (US); David Aguiar, Union City, CA (US)

(73) Assignee: Mizuho Orthopedic Systems, Inc, Union city, CA (US)

( * ) Notice: Subject to any disclaimer, the term of this patent is extended or adjusted under 35 U.S.C. 154(b) by 869 days.

(21) Appl. No.: 12/460,987

(22) Filed: Jul. 27, 2009

(51) Int. Cl.
*A47G 9/00* (2006.01)

(52) U.S. Cl.
USPC ..... 5/490; 5/636; 5/491; 5/652

(58) Field of Classification Search
USPC ..... 5/630, 636, 648, 652, 655.9, 490, 5/491
See application file for complete search history.

(56) References Cited

U.S. PATENT DOCUMENTS

| | | | | |
|---|---|---|---|---|
| 3,312,987 | A * | 4/1967 | Emery | 5/644 |
| 4,887,326 | A * | 12/1989 | O'Brien et al. | 607/109 |
| 5,048,542 | A * | 9/1991 | Murray | 128/889 |
| 6,230,349 | B1 * | 5/2001 | Silver et al. | 5/636 |
| 6,233,767 | B1 * | 5/2001 | Horowitz | 5/644 |
| 7,451,508 | B2 * | 11/2008 | Matthews Brown et al. | 5/655 |
| 7,657,954 | B1 * | 2/2010 | Bunkers | 5/644 |
| 2004/0200004 | A1 * | 10/2004 | Matthews Brown et al. | 5/655 |
| 2006/0031992 | A1 * | 2/2006 | Moore | 5/630 |
| 2009/0019641 | A1 * | 1/2009 | Ali | 5/636 |
| 2009/0133193 | A1 * | 5/2009 | Weise | 5/640 |

* cited by examiner

*Primary Examiner* — William Kelleher
(74) *Attorney, Agent, or Firm* — Theodore J. Bielen, Jr.

(57) ABSTRACT

A protection device for a chest pad having a central section lying intermediate to first and second wings sections. A first cover having a first chamber encloses the central section. Second and third covers including second and third chambers enclosed first and second wing sections. At least the second or third covers include a portion formed of resilient material permitting expansion of the second or third chambers, respectively.

3 Claims, 3 Drawing Sheets

SURGERY CHEST PAD PROTECTION DEVICE

BACKGROUND OF THE INVENTION

The present invention relates to a novel and useful surgery chest pad protection device.

Surgery tables typically allow a positioning of a patient in various positions to accommodate medical procedures such as examination and treatment. In addition, imaging takes place during many surgical procedures, requiring that a surgery table have a generally opened configuration. Further, patients positioned on such surgery tables are generally supported by pads having various configurations.

Among the supports provided for patients on a surgery table is a chest pad having a central support, as well as wings or flanges that extend outwardly and upwardly from the central support to firmly hold a patient in a proper configuration. Protection against contamination from surgical procedures is generally required for such pads and supports. In the past, sheets or drapes have been placed over the pads to achieve this result. Unfortunately, such a procedure generally results in tucks, wrinkles, folds, and the like which tend to cause shear on a patient. Such shear often results in skin damage to the patient during surgical procedures.

A surgery chest pad protection device which provides cross-contamination prevention and shear management would be a notable advance in the medical arts.

BRIEF SUMMARY OF THE INVENTION

In accordance with the present invention a novel and useful protection device for a chest pad used on a surgery table is herein provided.

The protection device of the present invention utilizes a first cover formed with a first chamber. The first chamber is intended to enclose the central section of the chest pad. The first cover is fashioned to slip over the central section of the chest pad and is employed in conjunction with second and third covers which are connected thereto and extend laterally therefrom. The first cover may include a flap, or a pair of flaps, each having a fastener which allows the holding of the first cover to the central section of the chest pad in a snug manner, such that the exterior surface of the first cover contacting the patient is free of wrinkles, folds, and the like.

The second and third covers hereto for mentioned are also utilized in the protection device of the present invention. The second and the third covers include second and third chambers respectively. The second and third chambers are employed to enclose the first and second wings sections of the chest pad, respectively. To insure that the second and third covers do not present or result in a wrinkled surface for contact with the patient, a resilient strip of material is used along the side portions of the second and third covers. Such resilient material strip allows the expansion of the second and third covers such that the second and third covers lie tightly around the first and second wings of the chest pad. Again, this structure permits the outer surfaces of the second and third covers to possess a smooth surface against the skin of the patient lying on the surgery table.

It may be apparent that a novel and useful protection device for a chest pad used on a surgery table has been hereinabove described.

It is therefore an object of the present invention to provide a protection device for a surgery table chest pad which includes separate covers for a central section of the chest pad and flanges or wings, which extend from the central section.

Another object of the present invention is to provide a protection device for a surgery table chest pad which includes features which permit the tightening of first, second, and third covers about various portion of a chest pad to allow a smooth surface to contact the skin of the patient on the surgery table.

Another object of the present invention is to provide a protection device for a surgery table chest pad which is simple to apply and is disposable after use.

Another object of the present invention is to provide a protection device for a chest pad used on a surgery table which prevents shear on the skin of a patient lying on a surgery table during medical procedures.

A further object of the present invention is to provide a protection device for a chest pad used on a surgery table which prevents cross-contamination by protecting the surgery table against exposure to matter resulting from surgical procedures.

The invention possesses other objects and advantages especially as concerns particular characteristic and features thereof which will become apparent as the specification continues.

Figure 1:
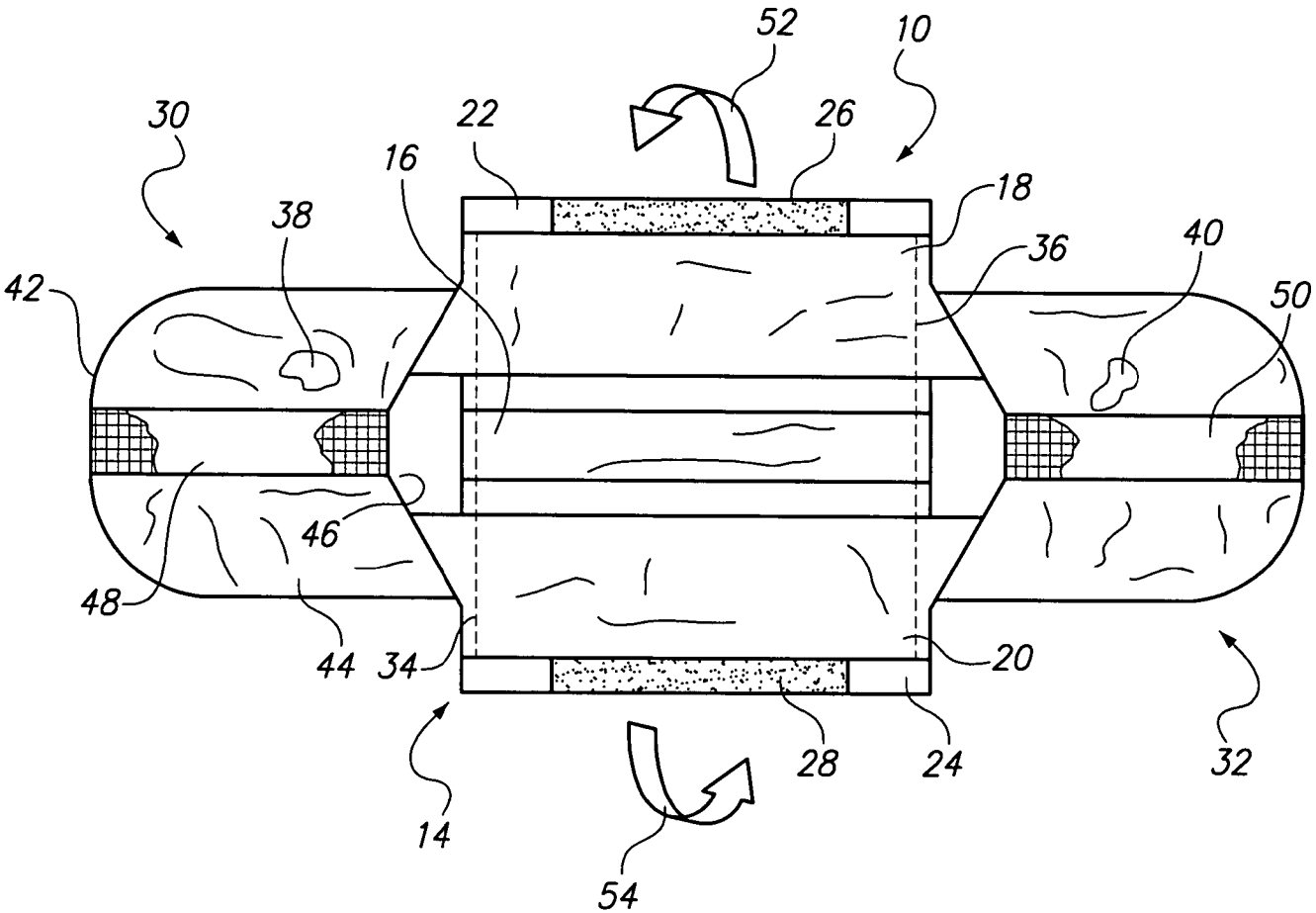
FIG. 1 is a bottom plan view of the device of the present invention in its open configuration.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

An embodiment of the invention as a whole is shown in the drawings by reference character 10. Device 10 is generally formed into three sections, which are used for covers of a surgery table chest pad 12, FIG. 2, which will be discussed in greater detail as the specification continues. First cloth cover 14 is formed with a top portion 16 and side portions 18 and 20, FIG. 1. Side portions 18 and 20 terminate in flaps 22 and 24. Flaps 22 and 24 further possess Velcro fasteners 26 and 28 which are used to hold cover 14 to chest pad 12. In this regard, Velcro strips 26 and 28 may interact to provide such fastening or may be fastened to complimentary strips, of the hook and pile type, found on a surgery table. In addition, other types of fasteners may be employed to hold first cover 14 to chest pad 12 such as strings, loops, snaps, magnetic fasteners, and the like.

Protection device 10 also includes cloth second cover 30 and third cover 32. Second cover 30 and third cover 32 extend from and are connected to first cover 14 via sew lines 34 and 36. Second and third covers 30 and 32 are formed into pouches or sheaths having inner chambers 38 and 40, revealed in broken away portions on FIG. 1. With respect to second cover 30, bottom or end portion 42 lies adjacent a side portion 44 which extends outwardly therefrom up to opening 46 to chamber 38. It should be noted that third cover 32 is similarly formed and, thus, the structure of third cover 32 will not be further discussed herein. Notably, second and third covers 30 and 32 are also formed with a resilient portion 48 and 50, respectively. Resilient portions 48 and 50 allow the expansion of chambers 38 and 40 when protection device 10 is placed on chest pad 12. Resilient portions 48 and 50 are depicted in FIG. 1, as strips of elastomeric mesh material. However, any resilient material may be used with second and third covers 30 and 32 in this regard. Directional arrows 52 and 54 indicate the folding of flaps 18 and 20 of first cover 14 toward top portion 16, which is illustrated as the undersides thereof in FIG. 1.

Figure 2:
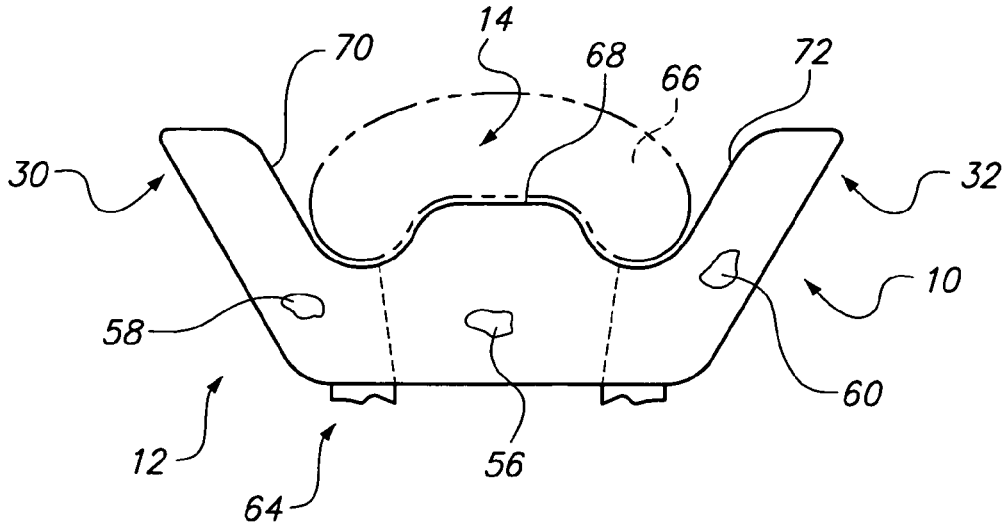
FIG. 2 is a schematic view of the device of the present invention fitted over a surgery table chest pad showing the outline of a patient in phantom.

Turning to FIG. 2, it may be observed that protection device 10 has been placed on chest pad 12. In general, chest pad 12 includes a central section 56 and wing or flange portions 58 and 60. Chest pad 12 lies atop components 64 of a surgery table, such as rails, bars, and the like. Patient 66 is shown in phantom, schematically, in order to indicate that the skin of patient 66 contacts outer surfaces 68, 70, and 72, of covers 14, 30, and 32, respectively. It should be noted that surfaces 68, 70, and 72 would contact the breasts of a female patient or an overweight patient extending beyond the phantom line 66 depicted in FIG. 2.

Figure 3:
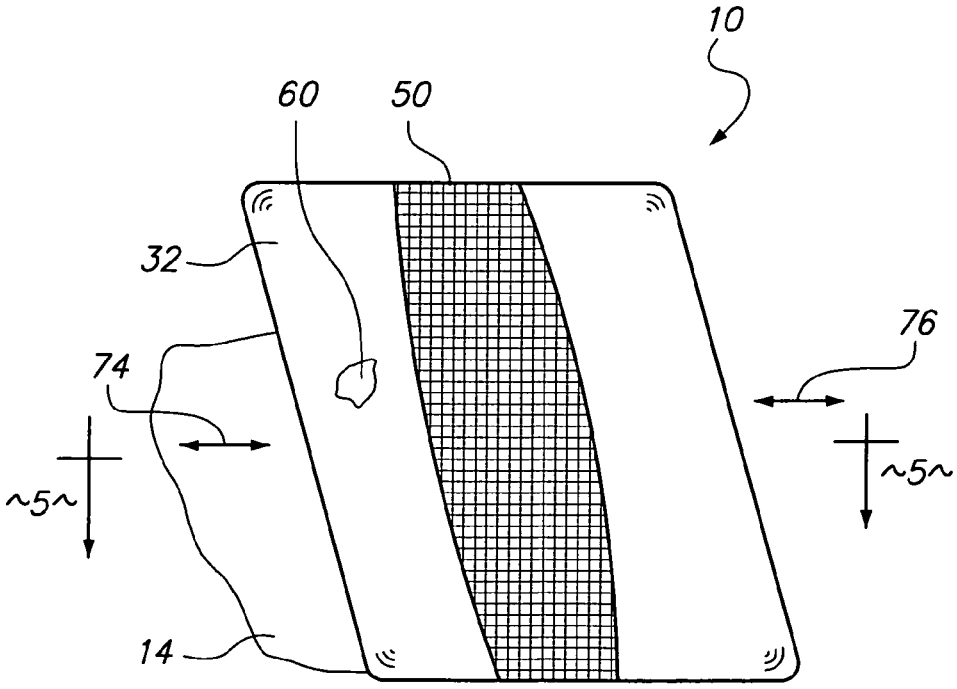
FIG. 3 is a right side end view of the device of the present invention is depicted in FIG. 2.
Figure 4:
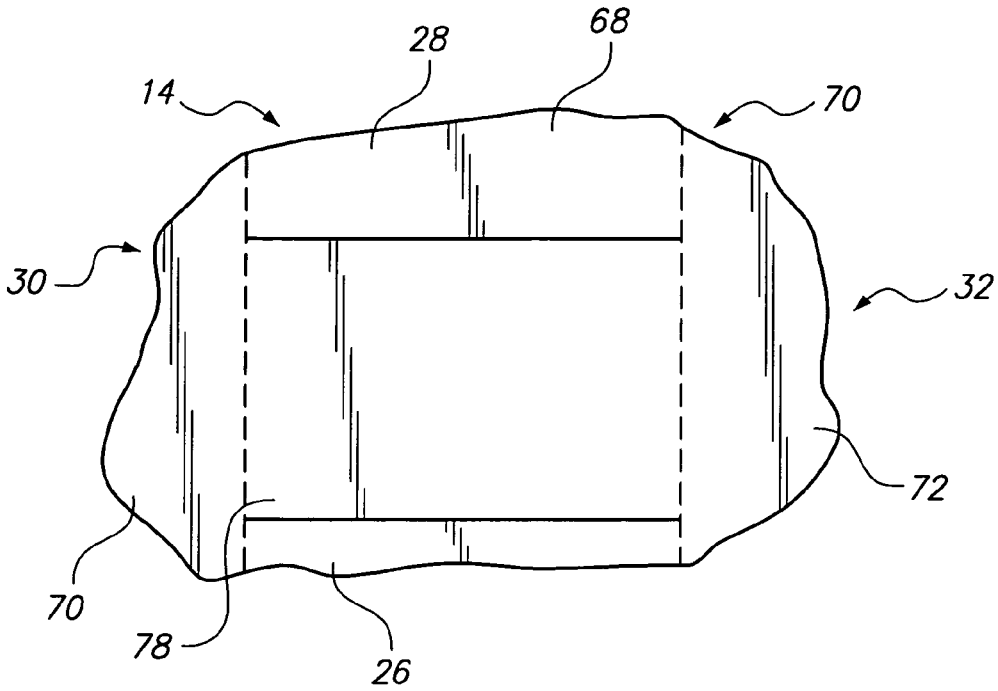
FIG. 4 is a partial top plan view of the device of the present invention as shown in FIG. 2.

With reference to FIG. 3, third cover 32 is depicted as being fitted over wing 60 of chest pad 12. Resilient portion 50 is also illustrated as being distorted or stretched according to directional arrows 74 and 76 due to the tight fit of third cover 32 over wing 60. By this expedient, the outer surface 72 possesses no wrinkles, tucks, or folds and, thus, presents a smooth surface to the skin of patient 66. The same situation results from the fitting of second cover 30 over wing 58 of chest pad 12. In addition, the tightening of first cover 14 via fasteners 26 and 28 forms a smooth platform 78 on outer surface 68 of first cover 14. Again, platform 78 is free of wrinkles or other interruptions on outer surface 68 which would contact the skin of patient 66, FIG. 4.

Figure 5:
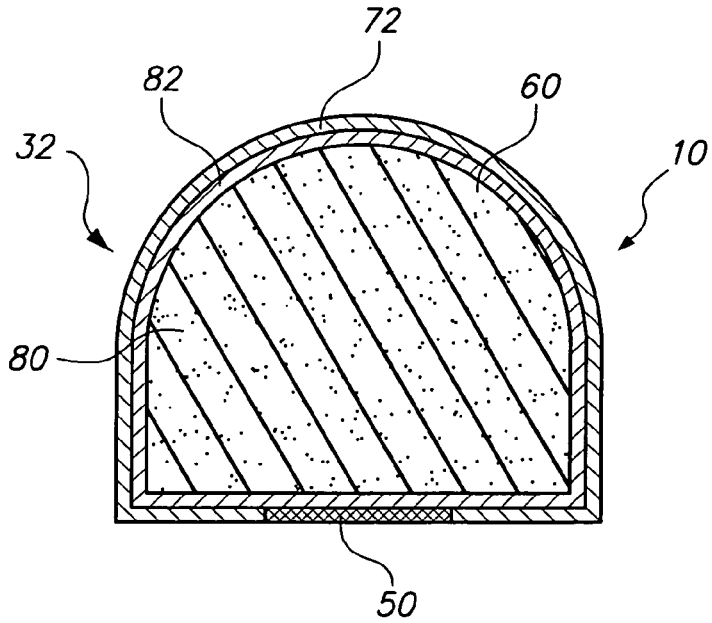
FIG. 5 is a sectional view taken along line 5-5 of FIG. 3.

FIG. 5 generally represents the composition of chest pad 12 and device 10. It may be observed, wing 58 and wing 60, as well as the remaining portions of chest pad 12, are formed of a foam plastic core 80 having a protective cover 82 formed of polymeric or leather material. Of course, cover 32 and the remaining portions of device 10 are formed of a fibrous, polymeric or cloth material and the like. Resilient portion 50 of cover 32 is held to cover 32 by sewing, welding, or by the use of other fastening mechanisms known in the art.

In operation, the user places protection device 10 over chest pad 12 such that first cover 14 encloses central section 56, while covers 30 and 32 over lie wings 60 and 58. First cover 14 is wrapped around central section 56 and fastened by the use of fasteners 26 and 28 to each other or to other complimentary fasteners found on the components 64 of the surgery table. Covers 30 and 32 enclose wings 58 and 60 of chest pad 12 such that resilient portions 48 and 50 of covers 30 and 32, respectively, stretch, typically shown in FIG. 3. In this manner, the outer surfaces 68, 70, and 72 of covers 14, 30, and 32 are generally smooth and greatly minimize shear damage to the skin of patient 66 during surgical procedures. Following use, protective device 10 may be deposed of accordingly.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A protection device for a surgery table, having a chest pad with a central section lying intermediate first and second wing sections;

comprising:

a. a first cover, said first cover comprising a central portion and first and second side portions extending from said central portion, each of said first and second side portions terminating in a flap, said flaps of said first and second side portions including a fastener to connect said first and second side portions to form a chamber enclosing the central section of the chest pad;

b. a second cover connected to said first cover, said second cover including a chamber having an opening thereto free of said chamber of said first cover, said chamber of said second cover enclosing the first wing section of the chest pad, said second cover being formed of cloth having an outer surface and a resilient portion permitting expansion of said second chamber and the smoothing of said second cover outer surface thereof; and c. a third cover connected to said first cover said third cover including a chamber having an opening thereto free of said chamber of said first cover, said chamber of said third cover enclosing the second wing section of the chest pad, said third cover being formed of cloth having an outer surface and a resilient portion permitting expansion of said third chamber and the smoothing of said second cover outer surface thereof.

2. The device of claim 1 in which said resilient portions of said first and second covers are elongated and extend along a certain dimension of each said first and second covers.

3. The device of claim 1 in which said fastener comprise a hook and pile fastener.

* * * * *